US009054463B2

(12) United States Patent
Kifedjian

(10) Patent No.: US 9,054,463 B2
(45) Date of Patent: Jun. 9, 2015

(54) AUDIO INTERFACE CONNECTOR WITH GROUND LIFT, KIT, SYSTEM AND METHOD OF USE

(71) Applicant: Avedis Kifedjian, Tujunga, CA (US)

(72) Inventor: Avedis Kifedjian, Tujunga, CA (US)

( * ) Notice: Subject to any disclaimer, the term of this patent is extended or adjusted under 35 U.S.C. 154(b) by 0 days.

(21) Appl. No.: 14/032,972

(22) Filed: Sep. 20, 2013

(65) Prior Publication Data

US 2015/0087187 A1 Mar. 26, 2015

(51) Int. Cl.

| | |
|---|---|
| ***H01R 13/10*** | (2006.01) |
| ***H01R 13/66*** | (2006.01) |
| ***H01R 13/71*** | (2006.01) |
| ***H01R 43/26*** | (2006.01) |

(52) U.S. Cl.

CPC ..... *H01R 13/665* (2013.01); *H01R 13/71* (2013.01); *H01R 43/26* (2013.01)

(58) Field of Classification Search

USPC ..... 439/620.09–620.14, 188, 668, 669

See application file for complete search history.

(56) References Cited

U.S. PATENT DOCUMENTS

| | | | | |
|---|---|---|---|---|
| 5,103,139 | A * | 4/1992 | Nilssen | 315/219 |
| 5,161,131 | A | 11/1992 | Borchardt et al. | |
| 5,290,179 | A * | 3/1994 | Weingartner | 439/669 |
| 5,483,436 | A * | 1/1996 | Brown et al. | 363/98 |
| 5,527,190 | A * | 6/1996 | Weingartner | 439/669 |
| 5,818,672 | A * | 10/1998 | Hilbe | 361/43 |
| 5,831,210 | A | 11/1998 | Nugent | |
| 5,893,767 | A | 4/1999 | Broschard | |
| 5,911,601 | A * | 6/1999 | Weingartner | 439/669 |
| 7,446,258 | B1 | 11/2008 | Sosna et al. | |
| 7,857,643 | B2 * | 12/2010 | Dobler | 439/172 |
| 8,246,384 | B1 | 8/2012 | Wallace | |
| 2008/0171475 | A1 * | 7/2008 | Antsos et al. | 439/668 |
| 2010/0112871 | A1 | 5/2010 | Yin | |
| 2012/0190226 | A1 | 7/2012 | Roberts, Jr. et al. | |
| 2014/0153144 | A1 * | 6/2014 | Lacey et al. | 361/45 |

FOREIGN PATENT DOCUMENTS

WO PCT/US2014/055244 2/2015

* cited by examiner

*Primary Examiner* — Gary Paumen

(74) *Attorney, Agent, or Firm* — John J. Connors; Connors & Assoc. PC

(57) ABSTRACT

In an audio system my balanced interface audio connector couples an audio driver device and an audio receiver device by means of a cable containing a pair of conductive differential lines within a shield. The balanced interface audio connector comprises an electronic filter and a manually operable switch by means of whose displacement between a first position and a second position, the electronic filter can be activated or deactivated. In the first position of the switch, the electronic filter is deactivated and the shield is connected to the audio connector's ground contact pin. In the second position of the switch, the electronic filter is activated and the shield is connected through the electronic filter prior to connection with the connector's ground contact pin. The method of using my balanced interface audio connector functions as a ground lift to safely break a ground current loop and simultaneously suppresses radio and electro-magnetic frequencies from contaminating the final audio program signal.

20 Claims, 17 Drawing Sheets

AUDIO INTERFACE CONNECTOR WITH GROUND LIFT, KIT, SYSTEM AND METHOD OF USE

INCORPORATION BY REFERENCE

Any and all U. S. patents, U. S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The words "disconnect" or "disconnected" means there is no electrical continuity through a conductor.

BACKGROUND OF THE INVENTION

Balanced interface audio connectors, such as, a male or female XLR (also known as a Cannon plug), a mini-male or mini-female XLR, and a ¼' TRS (also known as a tip-ring-sleeve or stereo jack plug) are used world-wide to interconnect audio devices by means of a shielded cable transmitting audio signals between two devices. The cable includes a pair of conductive differential lines enclosed within a conductive metallic tube or shield. Examples of prior art balanced audio connectors are disclosed in U.S. Pat. Nos. 5,527,190, 5,290,179, 5,911,601, and 7,857,643.

SUMMARY

When an audio system containing two or more audio devices is connected to a common ground through different paths, a ground current loop can occur causing unwanted noise voltage to flow through these multiple paths and contaminate the final audio program. My audio connector, kit, system and method breaks the flow of ground noise current from creating a ground current loop while simultaneously filtering radio and electromagnetic interference. My audio connector, kit, system and method have one or more of the features depicted in the embodiments discussed in the section entitled "DETAILED DESCRIPTION OF SOME ILLUSTRATIVE EMBODIMENTS." The claims that follow define my audio connector, kit, system and method, distinguishing them from the prior art; however, without limiting the scope of my audio connector, kit, system and method as expressed by these claims, in general terms, some, but not necessarily all, of their features are:

One, my balanced interface audio connector may be a male or female connector, for example, a male XLR, female XLR, male XLR mini-male XLR, mini-female XLR, ⅛' TRS, or a ¼' TRS type of connector.

Two, my balanced interface audio connector includes a plug component having a first front end adapted to be detachably connected directly to one audio device and a second rear end where one end of a cable with a pair differential lines in a shield is connected. This plug component may be a male or female element.

Three, the rear end retains a printed circuit board. This board may have two through-holes for a pair of connection sites for a pair of conductive differential lines extending from the one end of the shielded cable. The connection sites are positioned on the rear end of the plug component so that one site is adapted to be attached to an end of one differential line and the other site is adapted to be attached to an end of the other differential line.

Four, the printed circuit board may have an electronic filter thereon for connection to a portion of the cable's shield extending from the one end of the cable being attached to the balanced interface audio connector. Additionally, contained on the circuit board is a manually operable switch for activating or deactivating the filter.

Five, my kit comprises a package of the disassembled major components of my balanced interface audio connector. When required, a technician assembles these components, including soldering the differential lines from the cable end to the contact pins of the plug component and the cable shield to a portion of the circuit board.

Six, should ground noise current be present in an audio system, my method of using my balanced interface audio connector can safely break the flow of the ground noise current and avoid creating a ground current loop.

Seven, by activating the electronic filter my balanced interface audio connector includes means for creating a ground lift to safely break a ground current loop between a pair of connected audio devices.

Eight, by activating the electronic filter my balanced interface audio connector connects the shield through the electronic filter attenuating a 50 or 60-cycle hum, and their related harmonics, as well as radio and electromagnetic frequency interference.

These features are not listed in any rank order nor is this list intended to be exhaustive.

DESCRIPTION OF THE DRAWING

Some embodiments of my audio connector, kit, system and method are discussed in detail in connection with the accompanying drawing, which is for illustrative purposes only. This drawing includes the following figures (Figs.), with like numerals and letters indicating like parts.

DETAILED DESCRIPTION OF SOME ILLUSTRATIVE EMBODIMENTS

Figure 1:
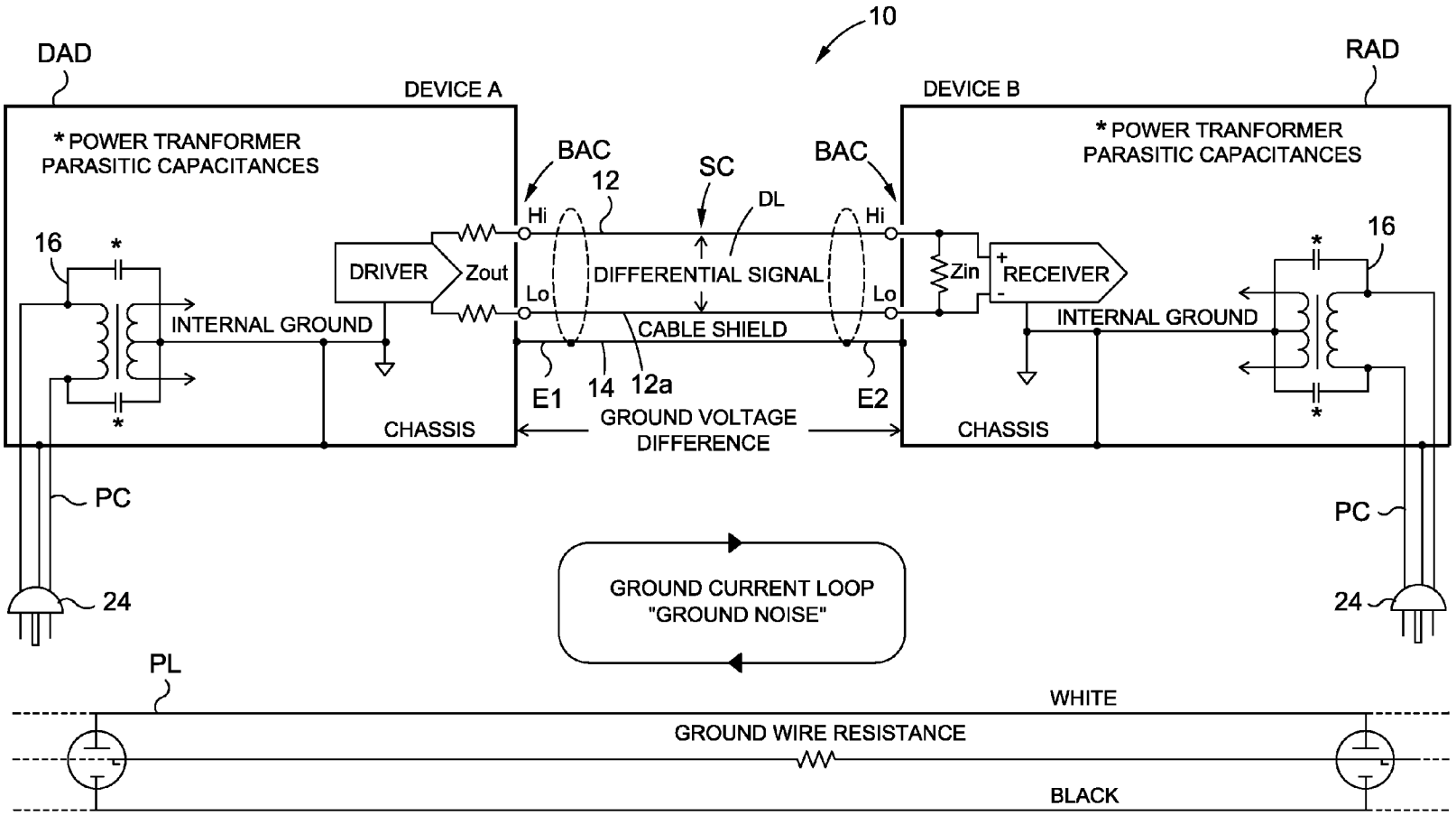
Fig. 1 (PRIOR ART)
FIG. 1 is a diagram illustrating the prior art manner of connecting two audio devices together in a conventional manner using a balanced audio connector and a pair of differential lines.
Figure 2:
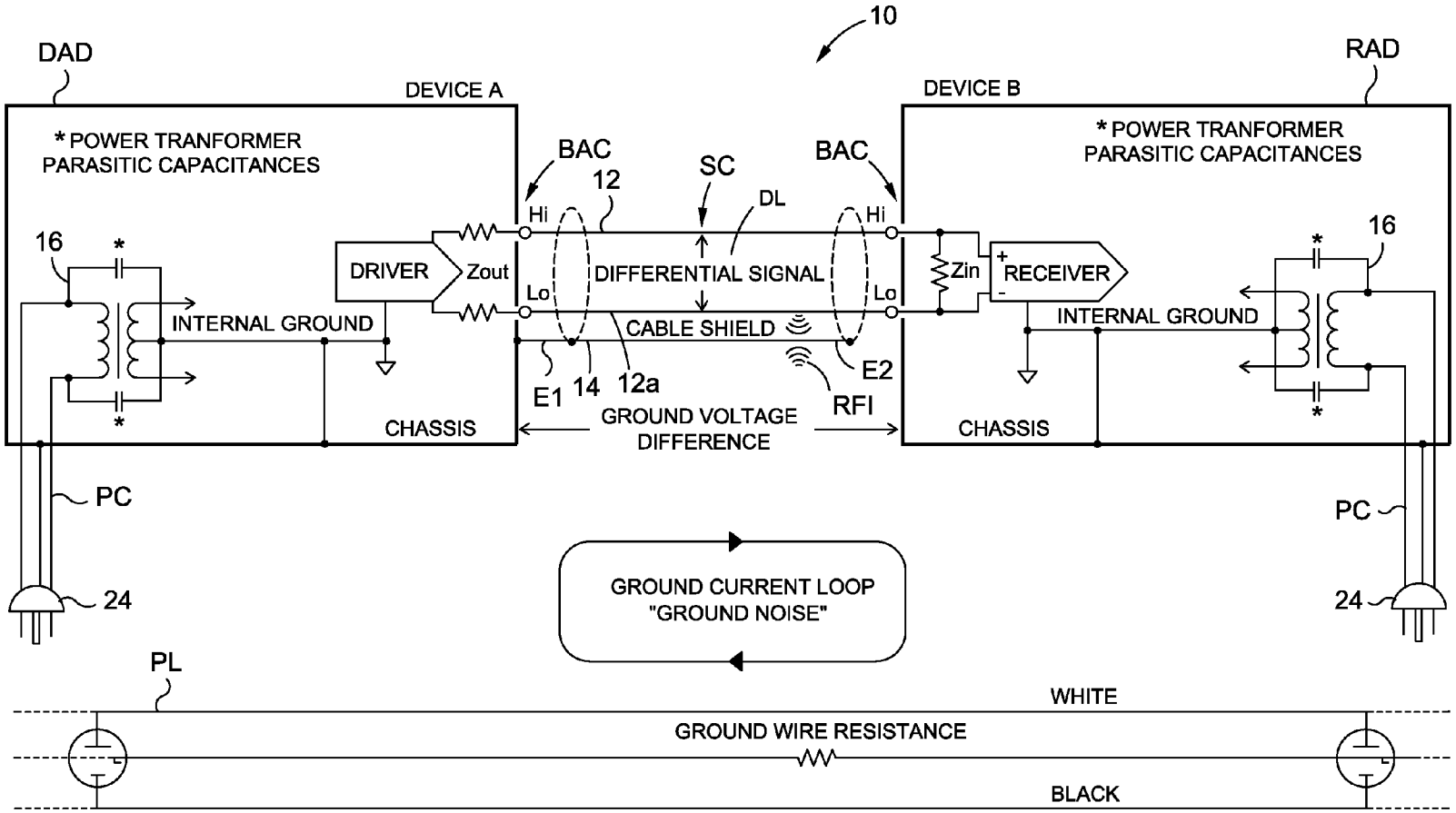
Fig. 2 (PRIOR ART)
FIG. 2 is a diagram similar to that of FIG. 1 illustrating a prior art method of disconnecting the cable shield at one end of the cable that connects the two audio devices together.
Figure 2A:
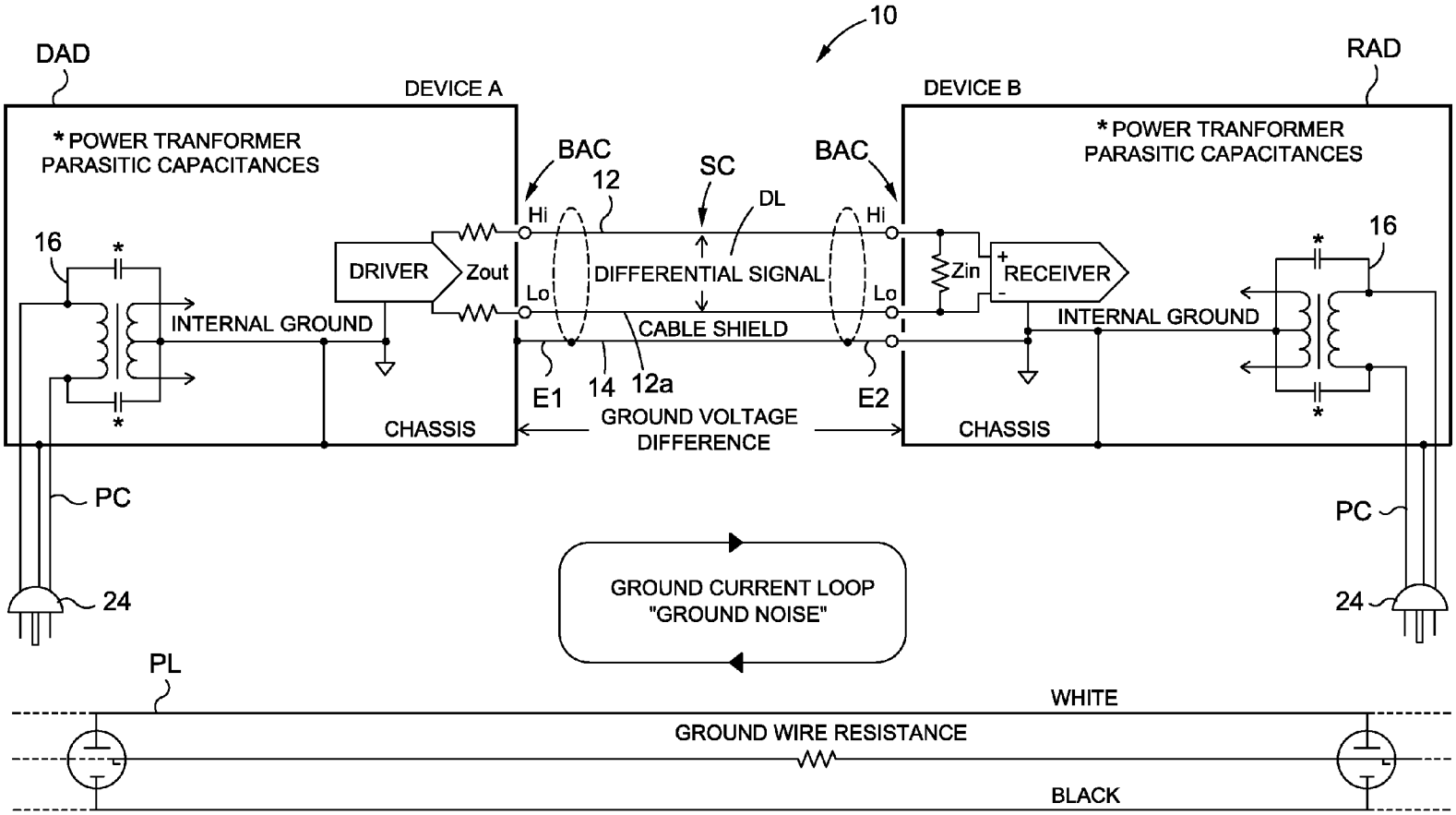
Fig. 2A (PRIOR ART)
FIG. 2A is a diagram similar to that of FIG. 1 illustrating a prior art method of connecting the internal ground of an audio device to the cable shield.

FIGS. 1 Through 2A (Prior Art)

Figure 1A:
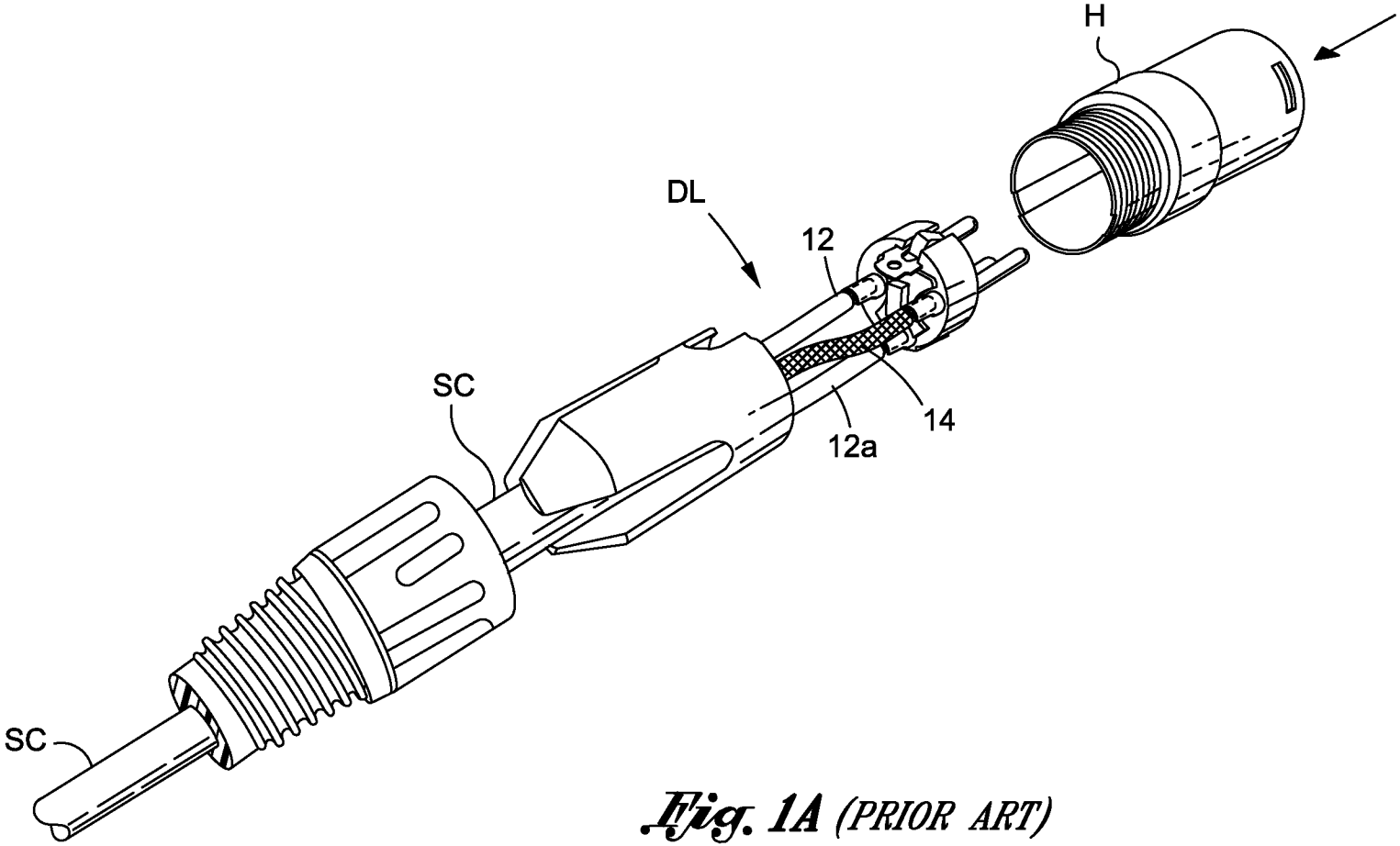
Fig. 1A (PRIOR ART)
FIG. 1A is an exploded perspective view illustrating the prior art manner of soldering a cable to a conventional audio connector for attaching two audio devices together.

As illustrated in FIG. 1, and generally designated by the numeral 10, there is schematically depicted a conventional audio system where a shielded cable SC connects together a driver audio device DAD and a receiver audio device RAD using a conventional balanced audio connector BAC at each end of the cable SC. As illustrated in FIG. 1A, the conventional cable SC includes a pair of conductive differential lines DL, Hi line 12 and Lo line 12*a* within a shield 14 comprising a metal housing H surrounds the cable SC and differential lines DL. The opposite ends of the pair of differential lines 12 and 12*a* are, respectively, connected to the driver audio device DAD and the receiver audio device RAD. The opposite ends E1 and E2 of the shield 14 are, respectively, connected to either the metal chassis, or the internal ground (FIG. 2A), or both, of the driver and receiver audio devices through the balanced audio connector BAC at each of the opposing ends of the cable SC. Each audio device has a power supply 16 connected to an AC power cord PC terminating in a three-pronged grounding plug 24. The three-pronged grounding plug 24 of the audio devices may be directly connected to a power line outlet with a socket having three terminals. For example, the driver audio device DAD and the receiver audio device RAD may be connected to an AC power line PL.

In actual practice, when two audio devices are connected to the same AC power line PL, the problem of a "ground current loop" can occur. A ground current loop arises when the inherently varying resistances in the individual audio device's ground path creates a voltage difference between the two audio devices. As a consequence of the ground reference no longer being at an equal potential, a conductive loop forms creating unwanted noise and interference currents; particularly 50 or 60 cycle AC "hum" and their related harmonics, which can manifest as a "buzz." These interference currents are induced and/or capacitively coupled into the audio signal; detrimentally becoming part of the final audio program. For example, as illustrated in FIG. 1, a ground current loop is created by current flowing from the AC power line PL, through the three-pronged grounding plug 24, up the power cord's PC ground, to the driver audio device DAD, then flowing from the driver audio device DAD, across the shield 14, to the receiver audio device RAD, down the receiver audio device's RAD power cord PC ground, through the three-pronged grounding plug 24, and again reconnecting to the AC power line PL. Even if both audio devices are powered by the same AC grounded outlet, due to parasitic capacitances in the audio devices' individual power supply, there will be a voltage difference between the two audio devices. This again allows interference currents to loop and contaminate the audio devices internal ground and the final audio program signal. To prevent a ground current loop from contaminating the audio program signal, the "loop" must be broken. This may be accomplished in several ways. One way to break the loop is to defeat the safety ground prong on the power cord PC of the audio device. For example, the safety ground prong of the three-pronged grounding plug 24 of an audio device is either broken off or taped over. Or, more simply, an AC ground lifter (also know as a cheater-plug or "3 to 2") is used, but the conductive ground wire of the AC ground lifter, which helps maintain safety in the event of a ground fault, is not screwed to an AC outlet's grounded cover plate. These examples, however, violate the National Electrical Code, can damage an audio device, and can potentially expose one to electric shock.

As shown in FIG. 2, another way to break the loop is to cut and disconnect the shield 14 at the end E2 of the receiver audio device RAD, so the shield 14 no longer makes contact with the metal chassis, internal ground, or both. Since the shield 14 can be difficult to access once the cable SC has been soldered into place, this is not a practical solution. Moreover, due to inductive reactance, the disconnected end of the shield 14 may act as an antenna and pick up unwanted high frequency radio interference signals RFI. Increasingly, manufacturers have used insulated plastic housings and insulated printed circuit board mounted audio interface connectors as the audio interface connector on an audio device instead of conductive metal housings. Moreover, today's printed circuit board designers conveniently, but incorrectly, connect the shield from the printed circuit board mounted audio interface connector to the internal audio ground, instead of the chassis ground of the audio device. As illustrated in FIG. 2A, the internal ground of the receiver audio device RAD then becomes directly connected to the shield 14 of the cable SC. Such a design does not break the ground current loop and actually induces interference currents directly onto the internal audio ground of the audio device; consequentially becoming part of the final audio program. Ideally, the shield 14 of the cable SC should be connected to the audio device's chassis directly at the entrance of the device's audio interface connector. This keeps the ground current loop flowing through the chassis and unable to contaminate the internal audio ground.

FIGS. 3 Through 12

Figure 3:
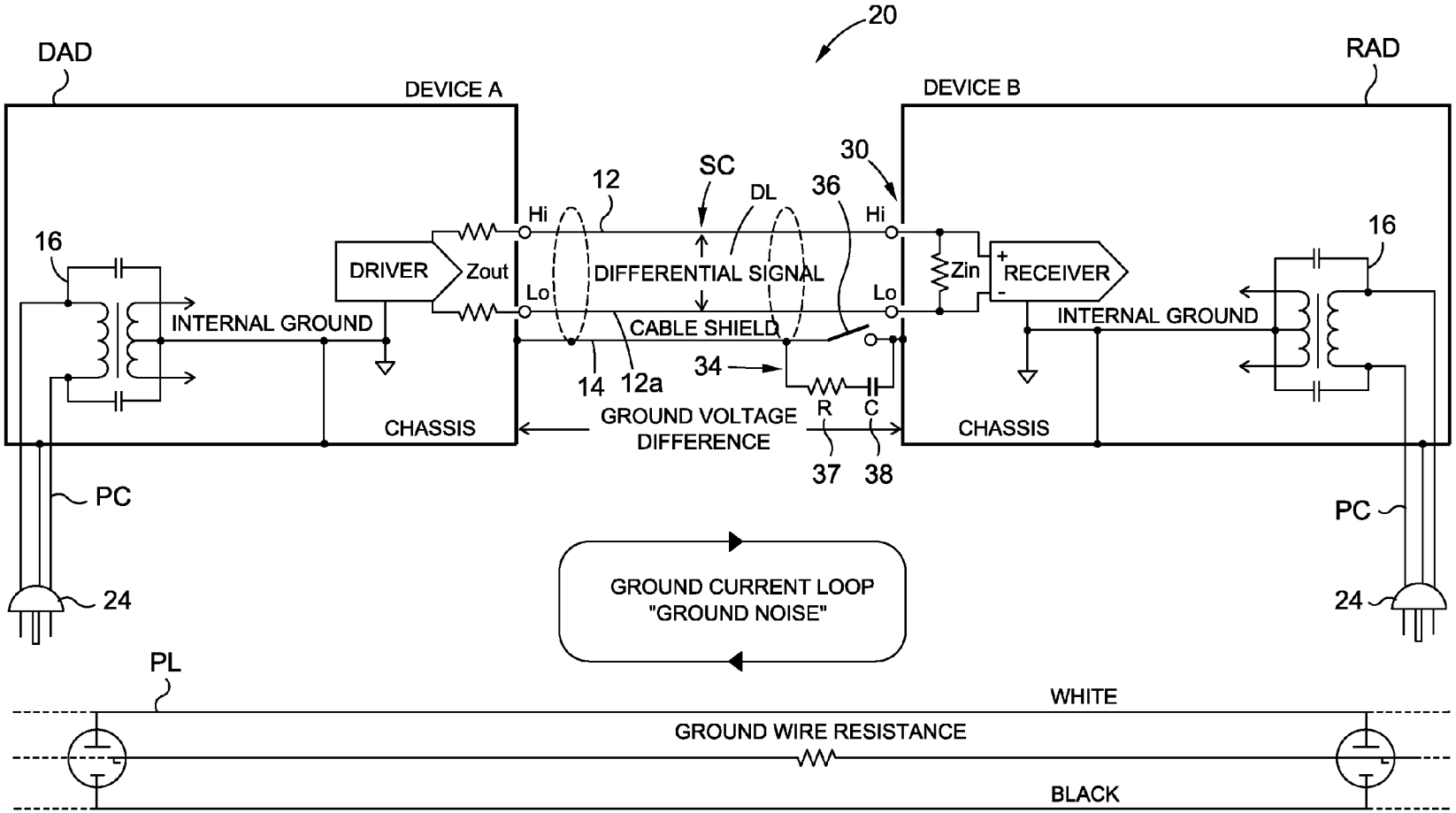
FIG. 3 is a diagram illustrating my system that connects two audio devices together in accordance with my method of breaking the flow of ground noise current and filtering radio and electromagnetic frequency interference currents.
Figure 3A:
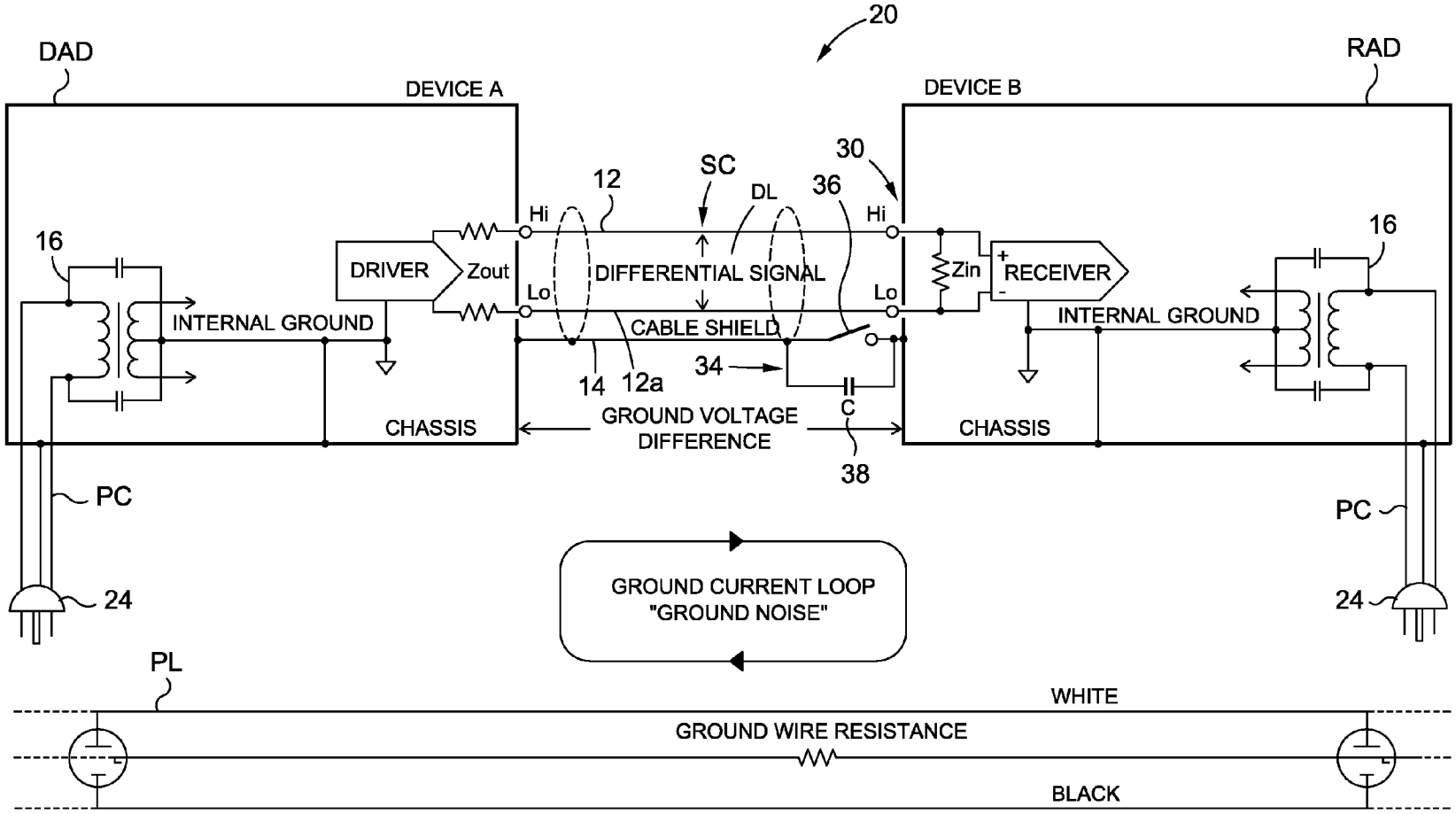
FIG. 3A is a diagram illustrating an alternate embodiment of my system that connects two audio devices together in accordance with my method.
Figure 4:
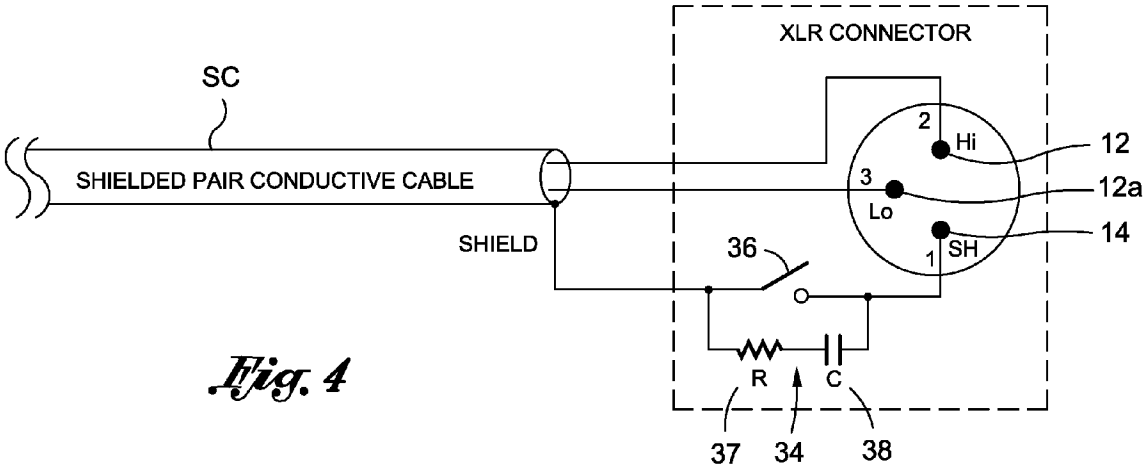
FIG. 4 is a schematic illustration of one embodiment of my XLR balanced interface audio connector utilizing a resistor and capacitor network as an electronic filter with its manual toggle switch in the open position, activating the filter and lifting the ground.
Figure 4A:
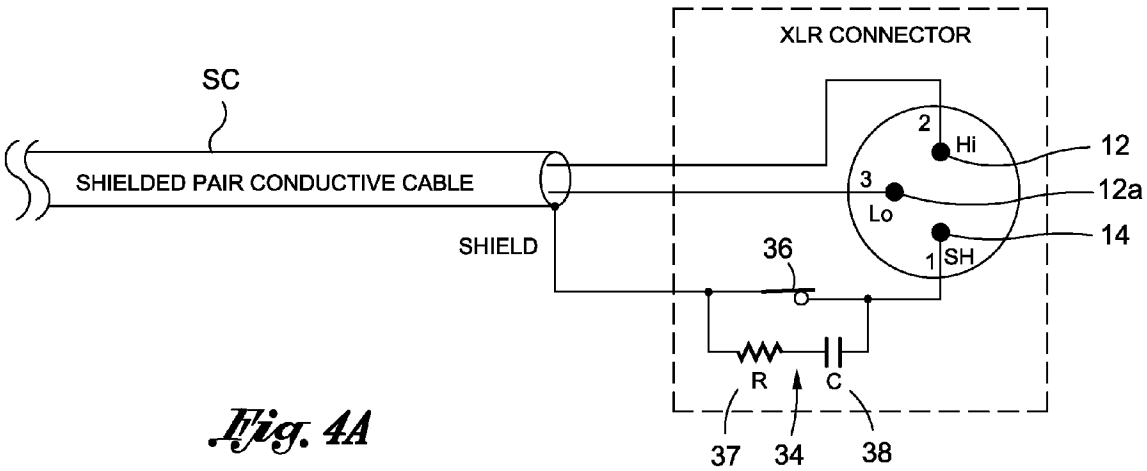
FIG. 4A is a schematic illustration of my XLR balanced interface audio connector shown in FIG. 4 with its manual toggle switch in the closed position, deactivating the filter and reconnecting the ground.
Figure 4B:
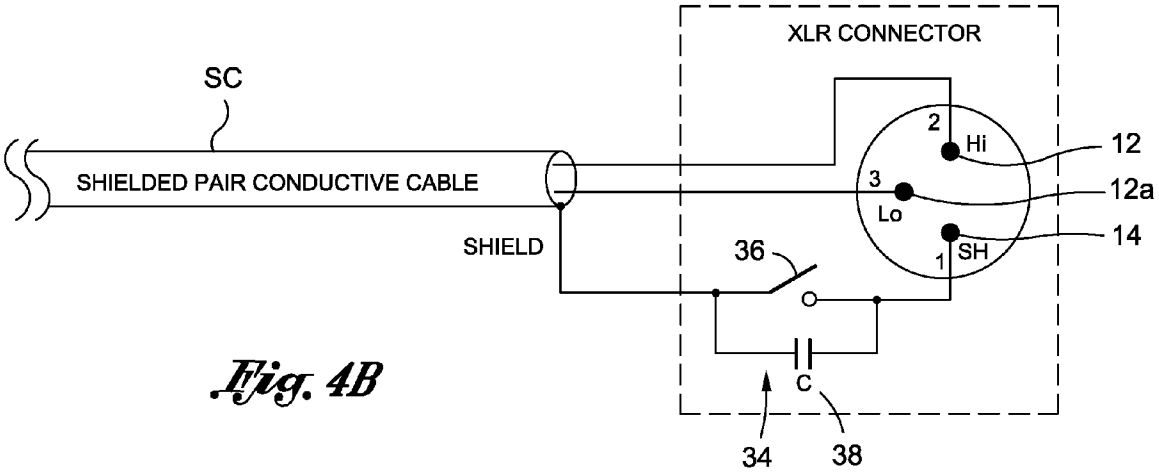
FIG. 4B is a schematic illustration of an alternate embodiment of my XLR balanced interface audio connector utilizing a capacitor network as an electronic filter with its manual toggle switch in the open position, activating the filter and lifting the ground.
Figure 4C:
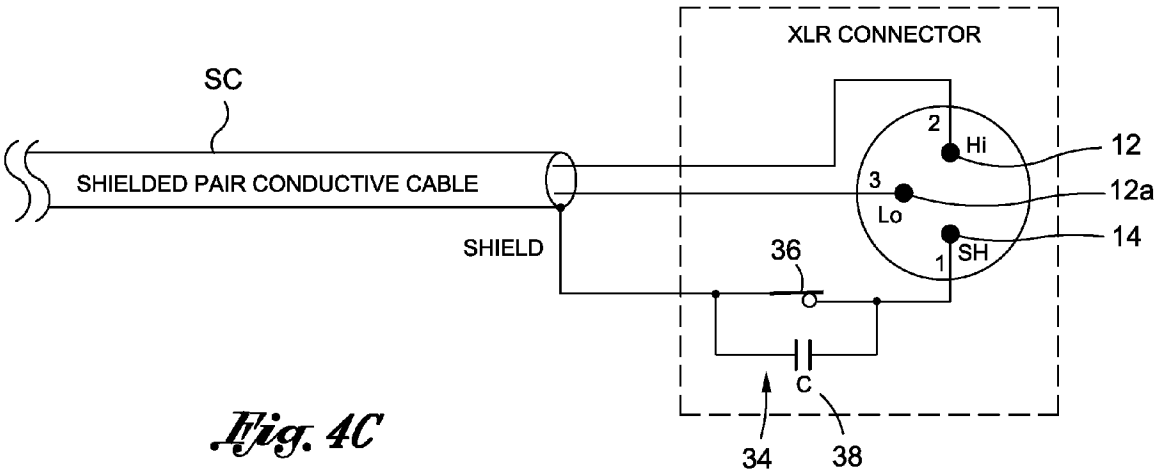
FIG. 4C is a schematic illustration of an alternate embodiment of my XLR balanced interface audio connector shown in FIG. 4B with its manual toggle switch in the closed position, deactivating the filter and reconnecting the ground.
Figure 4D:
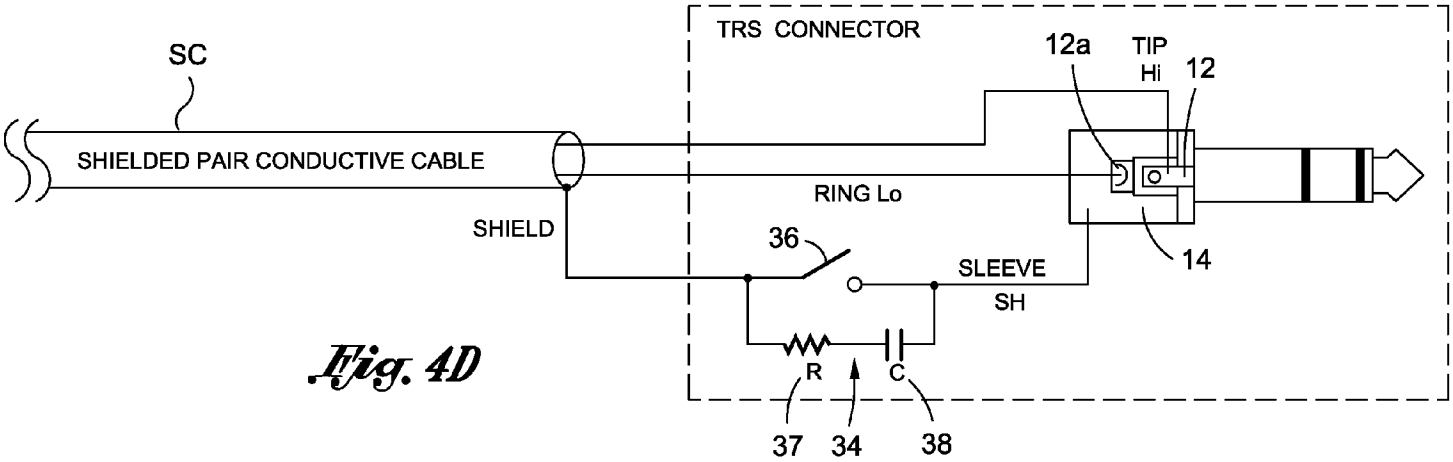
FIG. 4D is a schematic illustration of one embodiment of my balanced interface audio connector utilizing a ¼' TRS jack and a resistor and capacitor network as an electronic filter with its manual toggle switch in the open position, activating the filter and lifting the ground.
Figure 4E:
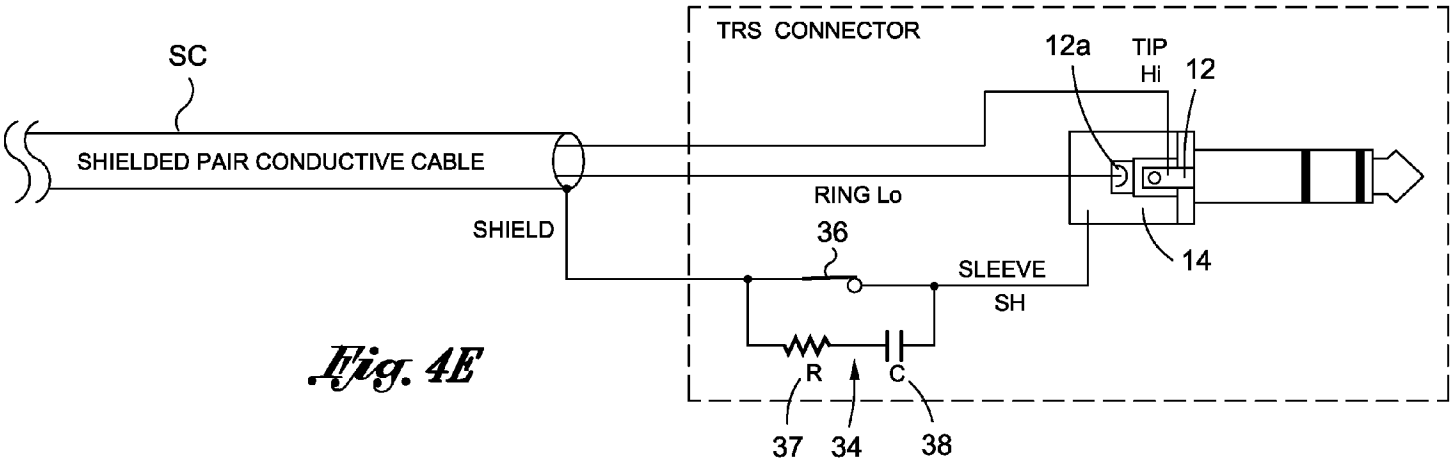
FIG. 4E is a schematic illustration of my balanced interface audio connector shown in FIG. 4D with its manual toggle switch in the closed position, deactivating the filter and reconnecting the ground.
Figure 4F:
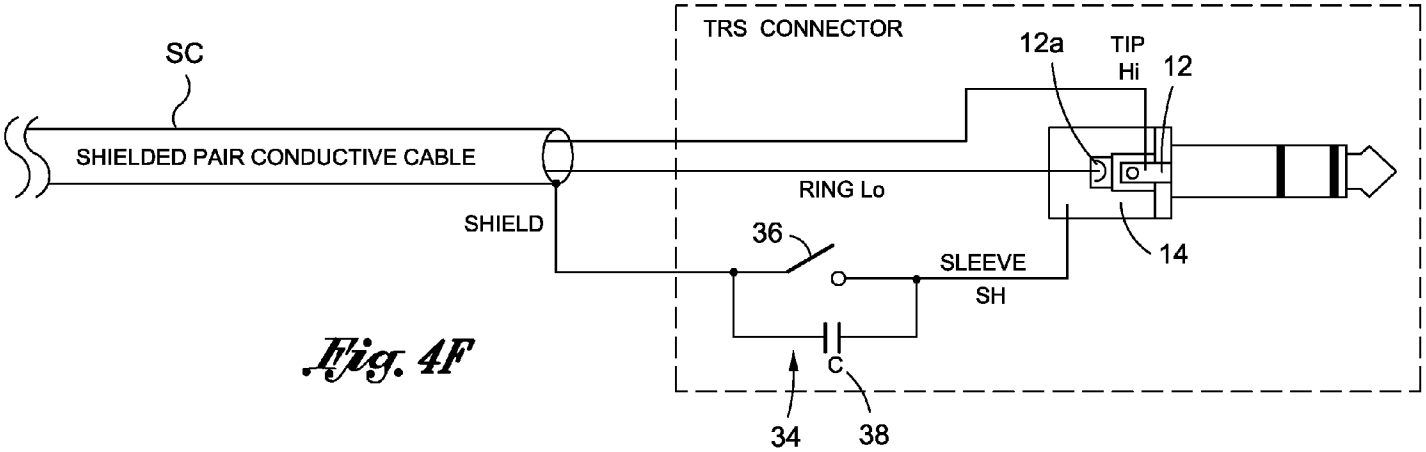
FIG. 4F is a schematic illustration of an alternate embodiment of my balanced interface audio connector utilizing a ¼' TRS jack and a capacitor network as an electronic filter with its manual toggle switch in the open position, activating the filter and lifting the ground.
Figure 4G:
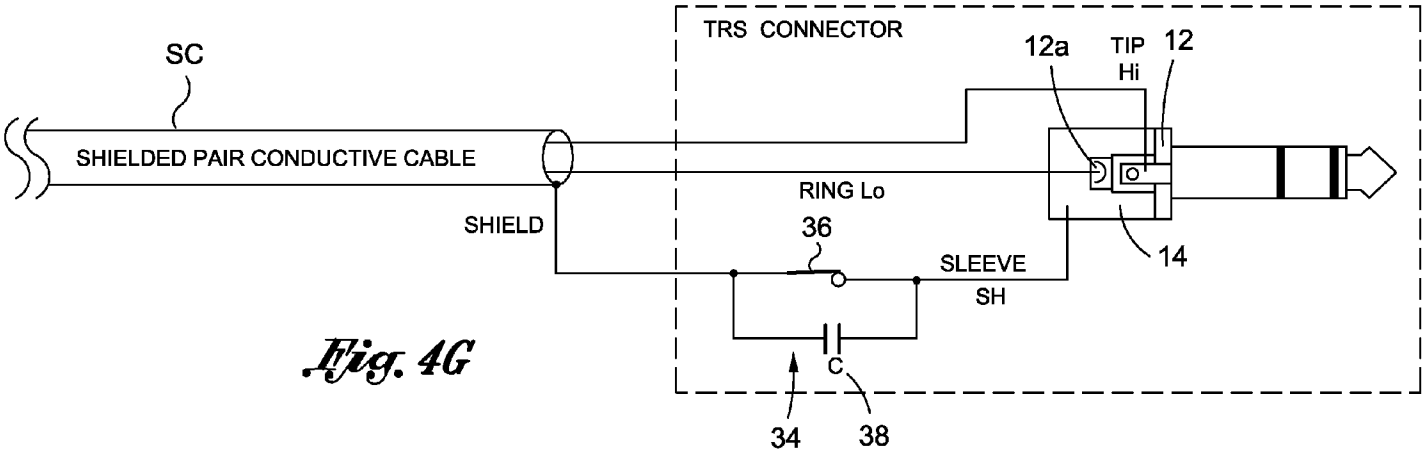
FIG. 4G is a schematic illustration of an alternate embodiment of my balanced interface audio connector shown in FIG. 4F with its manual toggle switch in the closed position, deactivating the filter and reconnecting the ground.
Figure 5A:
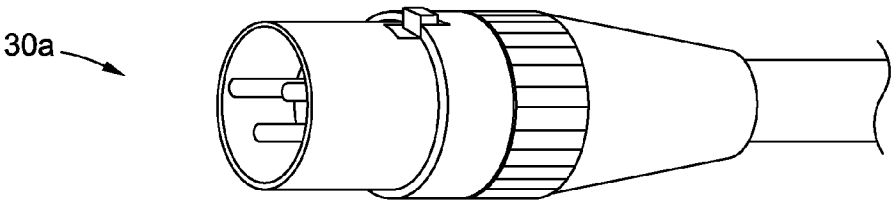
FIG. 5A is a perspective view of one embodiment of my XLR balanced interface audio connector where its connecting component is configured as a plug element.
Figure 5B:
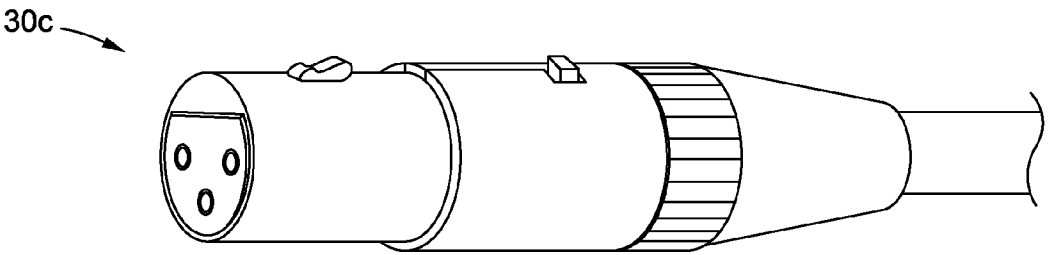
FIG. 5B is a perspective view of a second embodiment of my XLR balanced interface audio connector where its connecting component is configured as a socket element.
Figure 5C:
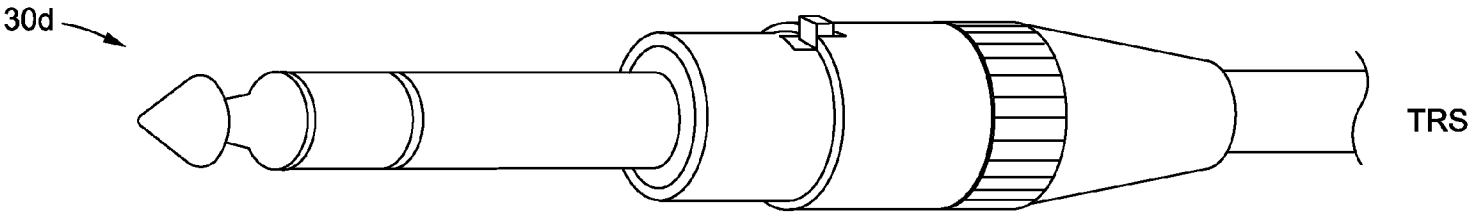
FIG. 5C is a perspective view of a third embodiment of my balanced interface audio connector where its connecting component is configured as a TRS jack plug element.
Figure 7:
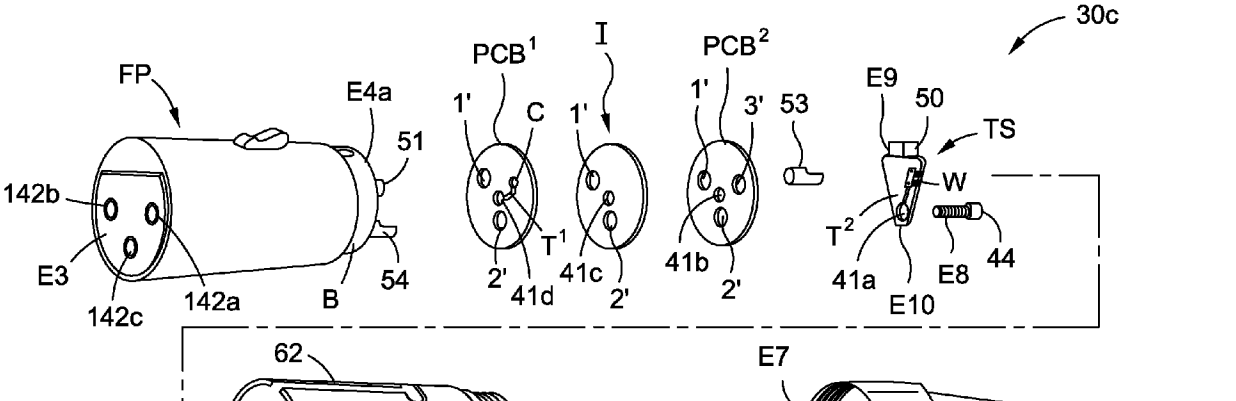
FIG. 7 is an exploded perspective view of the embodiment of my balanced interface audio connector shown in FIG. 5B.
Figure 8:
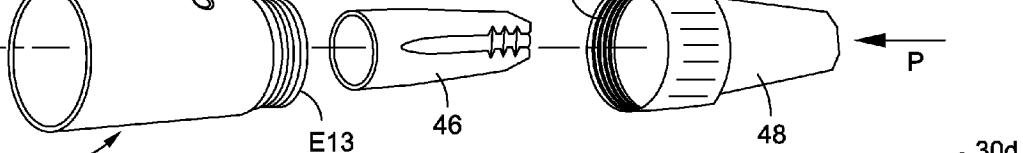
FIG. 8 is an exploded perspective view of the embodiment of my balanced interface audio connector shown in FIG. 5C.
Figure 8:
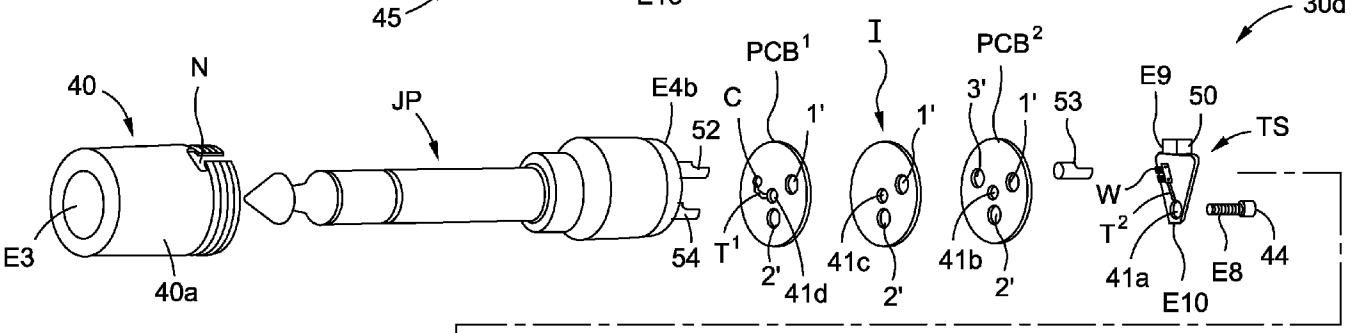
Figure 8:
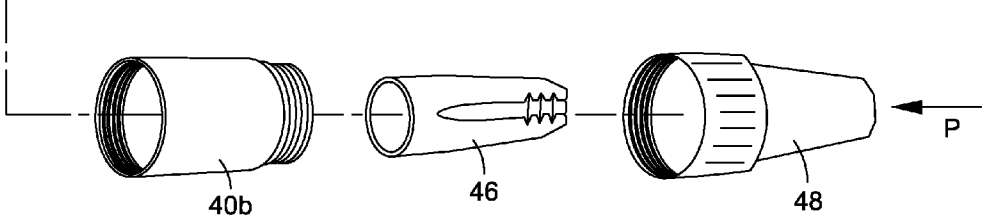

My system, schematically illustrated in FIG. 3 and generally designated by the numeral 20, safely breaks a ground current loop while simultaneously shunting radio frequency interference, electro-magnetic interference, or both, from contaminating the final audio program signal. At the end of the shielded cable SC, connected to the receiver audio device RAD, is my balanced interface audio connector generally designated by the numeral 30. The connector 30 may include a two-part metal housing 40 (FIGS. 6, 6A, and 8) or a one-part metal housing 45 (FIG. 7). The connector 30 has a first end E3 (FIGS. 6, 6A, 7, 8) adapted to be detachably connected directly to one of the audio devices. The connector 30 has contained within a printed circuit board PCB (FIGS. 9 through 11A) including an electronic filter 34. As illustrated in FIGS. 3, 4, 4A, 4D, and 4E, the electronic filter 34 may be an RC network comprising a resistor 37 in series connection with a capacitor 38. Alternatively, as illustrated in FIGS. 3A, 4B, 4C, 4F and 4G, the filter 34 may be a C network comprising a capacitor 38. The values of the resistor 37 and the capacitor 38 can be variably tuned for reducing problematic radio and electro-magnetic interference. As illustrated in FIGS. 4 through 4G, the electronic filter 34 is in parallel connection with a manually operable switch 36. The switch 36 can be displaced between a first position and a second position. When the switch 36 is in the first position, the circuit is closed and the electronic filter 34 is deactivated (FIGS. 4A, 4C, 4E, 4G). When the switch 36 is in the second position, the circuit is open and the electronic filter 34 is activated (FIGS. 4, 4B, 4D, 4F). My balanced interface audio connector 30 may be a male XLR type connector 30*a* and 30*b* as illustrated in FIG. 5, FIGS. 6, and 6A; a female XLR type connector 30*c* as illustrated in FIG. 5B and FIG. 7; a male or female mini XLR type connector (not shown); or a male TRS type connector 30*d* as illustrated in FIG. 5C and FIG. 8; or a female TRS type connector (not shown).

Figure 6:
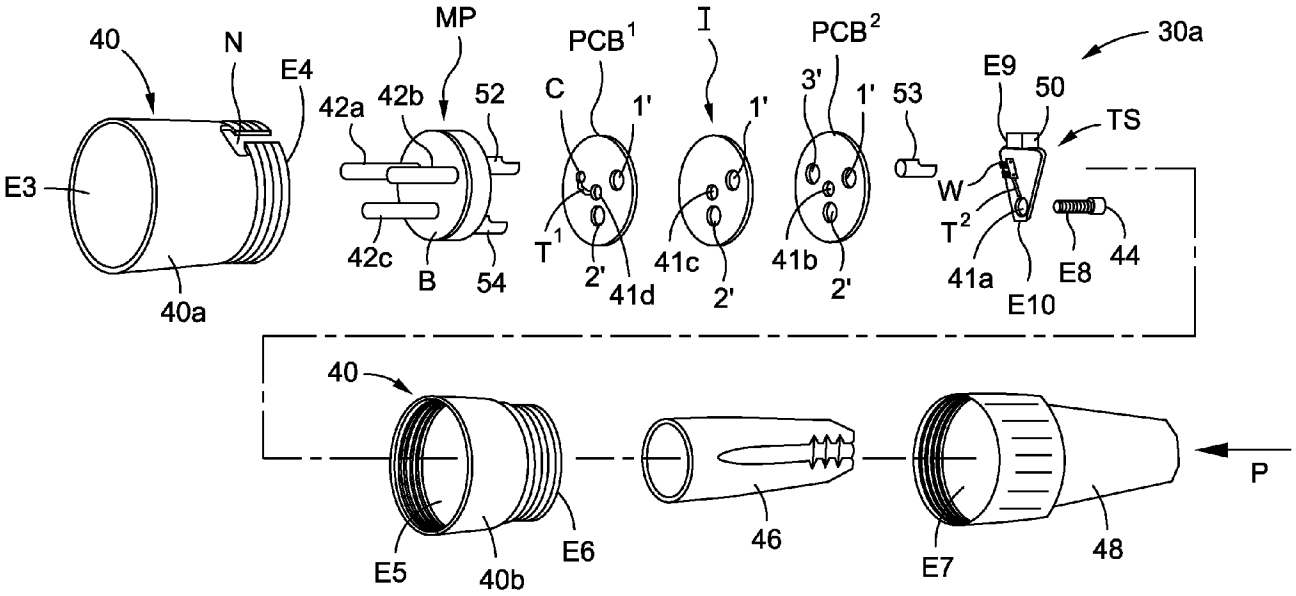
FIG. 6 is an exploded perspective view of the embodiment of my balanced interface audio connector shown in FIG. 5A.
Figure 6A:
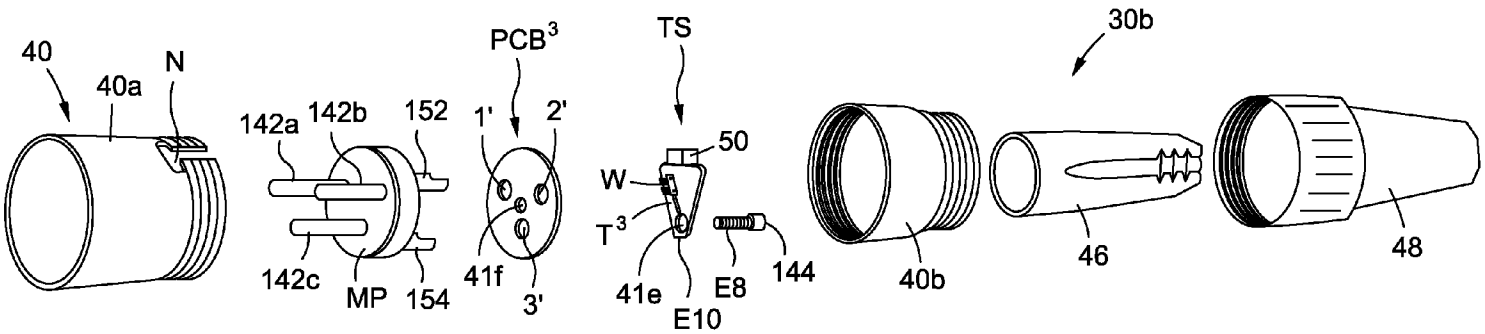
FIG. 6A is an exploded perspective view of an alternate embodiment of my balanced interface audio connector shown in FIG. 5A.

As depicted in FIG. 6, the male XLR type connector 30*a* includes a two-part metal housing 40, a male connecting component plug MP with three conductive contact pins 42*a*, 42*b*, 42*c* held in place by an insulating mounting component B, a first printed circuit board $PCB^1$, an insulator I made of a non-conductive material, a second printed circuit board $PCB^2$ containing the electronic filter 34, a manually operable toggle switch TS, a screw 44, a strain relief member 46, and a rear-housing member 48. In relation to a conventional male XLR connector, conductive contact pins 42*a*, 42*b*, and 42*c* equate respectively to contact pin 1, contact pin 2, and contact pin 3; wherein, contact pin 1 is for connection of the cable shield to chassis ground; contact pin 2 is for connection of the Hi, in phase, differential line to the positive polarity of the audio devices circuit; and contact pin 3 is for connection of the Low, out of phase, differential line to the negative polarity of the audio devices circuit.

The two-part metal housing 40 comprises a hollow metal cylinder 40*a* and hollow metal cylinder 40*b*. The end E4 of the hollow metal cylinder 40*a* is externally threaded and notched, and the hollow metal cylinder 40*b* has internal threads at an end E5 so as to join the two-part metal housing 40 together. The hollow metal cylinder 40*b* has an externally threaded end E6 for connection to an internally threaded end E7 of the rear-housing member 48. The insulating strain relief member 46 and the rear-housing member 48 are each made of a non-conductive material and each has therein a passageway P for the shielded cable SC to be passed through. The strain relief member 46 and rear-housing member 48 are configured such that when they are assembled, the strain relief member 46 is seated snugly within the hollow metal cylinder 40*b* and the rear-housing member 48. The male connecting component plug MP has a pair of connection or soldering cups 52 and 54 which are portions of the contact pins 42*b* and 42*c*, conventionally projecting from the inside face of the insulating mounting component B of the male connecting plug MP. Contact pin 42*a* projects slightly from the inside face of the insulating mounting component B of the male connecting plug MP to form a post 51 (not show).

As illustrated in FIG. 6, a first printed circuit board $PCB^1$ contains two non-conductive through-holes 1' and 2', a conductive central hole 41*d*, a trace $T^1$, and a conductive contact point C. The contact point C is in connection with the trace $T^1$ and connects the contact point C to the central hole 41*d*. As illustrated in FIG. 6, the insulating member I contains two through-holes 1' and 2' and a central hole 41*c*. The insulating member I protects the contact point C and the pin 42*a*, from conductively connecting to the soldering site 53. As illustrated in FIG. 6, the second printed circuit board $PCB^2$ contains two non-conductive through-holes 1' and 2', a conductive through-hole 3', and a non-conductive central hole 41*b*. A connection or soldering cup 53 is riveted onto the hole 3'. As illustrated in FIG. 6, the toggle switch TS contains a lever arm 50, a wiper member W, a trace $T^2$, and a conductive central hole 41*a*.

The through-holes 1' and 2' of the printed circuit board PCB', insulating member I, and the printed circuit board $PCB^2$ are positioned to receive, respectively, each contact pin 42*b* and 42*c* projecting from the inside face of the insulating mounting component B of the male connecting plug MP. The hole 3' of the printed circuit board $PCB^2$ and the soldering cup 53 are in alignment with, but conductively isolated from, the portion of the contact pin 42*a* projecting from the inside face of the insulating mounting component B. When assembled, the post 51, projecting from the inside face of the insulating mounting component B, abuts against and makes a conductive connection with the contact point C on the circuit board $PCB^1$. The lever arm 50 of the manually operable toggle switch TS is mounted at its inner end E10 allowing it to pivot on axis. The central holes 41*a*, 41*b*, 41*c*, and 41*d* allow for a threaded end E8 of the screw 44 to pass and screw into a threaded receptacle (not shown) on the inside face of the male connecting plug MP. As depicted in FIG. 11, when the screw 44 is threaded into place, this allows the circuit board $PCB^1$, insulating member I, circuit board $PCB^2$, and the toggle switch TS to be firmly attached to the rear of the male connecting plug MP. The Hi line 12 of the cable SC is connected to the soldering site 52. The Lo line 12*a* of the cable SC is connected to the soldering site 54. The shield 14 is connected to the soldering site 53. The metal cylinder 40*a* and metal cylinder 40*b* are threaded together with the male connecting plug MP, circuit board $PCB^1$, insulator member I, circuit board $PCB^2$, and the toggle switch TS housed within. With the metal cylinder 40*a* and metal cylinder 40*b* threaded together, adjoining edges of these cylinders abut to form a notch N between them which receives an outer end E9 of the toggle switch TS, exposing the lever arm 50.

Figure 9A:
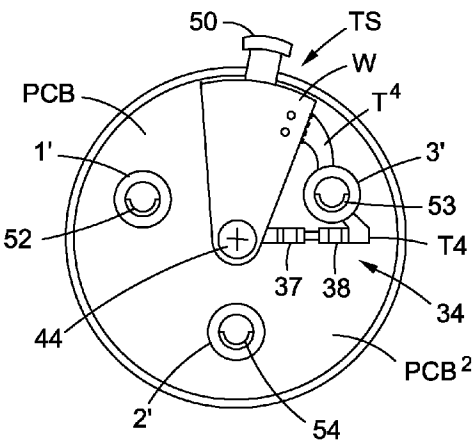
FIG. 9A is a plan view of a circuit board of my balanced interface audio connector showing its toggle switch mounted to the printed circuit board and in a closed position corresponding to the switch position depicted in FIG. 4A.
Figure 9:
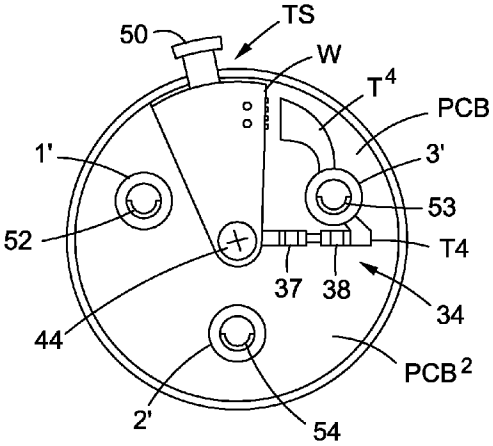
FIG. 9 is a plan view of a circuit board of my balanced interface audio connector showing its toggle switch mounted to the printed circuit board and in an open position corresponding to the switch position depicted in FIG. 4.
Figure 9C:
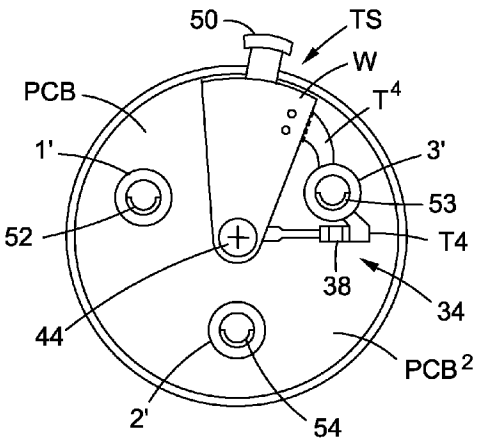
FIG. 9C is a plan view of an alternate embodiment of the printed circuit board of my balanced interface audio connector showing its toggle switch mounted to the printed circuit board and in a closed position corresponding to the switch position depicted in FIG. 4C.
Figure 9B:
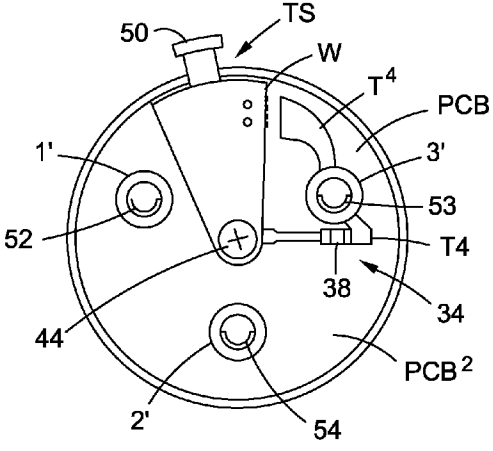
FIG. 9B is a plan view of an alternate embodiment of the printed circuit board of my balanced interface audio connector showing its toggle switch mounted to the printed circuit board and in an open position corresponding to the switch position depicted in FIG. 4B.

As illustrated in FIGS. 9 and 9A, the printed circuit board PCB contains the electronic filter 34 comprising a resistor 37, a capacitor 38, and a trace $T^4$. Alternatively, as illustrated in FIGS. 9B and 9C, the printed circuit board PCB contains the electronic filter 34 comprising of a capacitor 38 and a trace $T^4$. By pivoting the manually operable toggle switch TS between a first closed position and a second open position, the electronic filter 34 is either activated or deactivated. With the toggle switch TS in the first closed position (FIGS. 9A and 9C) the electronic filter 34 is deactivated and the shield 14 is in conductive connection with the contact pin 42*a* via the soldering cup 53 and the conductive hole 3', through the trace $T^4$, wiper W, trace $T^2$, screw 44, conductive central hole 41*a*, conductive central hole 41*d*, trace $T^1$, and contact point C. When the electronic filter 34 is deactivated, my balanced interface audio connector 30 functions as though conventionally grounded; however, it is while in this deactivated or grounded mode the problems associated with a ground current loop can occur. With the toggle switch TS in the second open position (FIGS. 9 and 9B) the electronic filter 34 is activated and the shield 14 is simultaneously disconnected from the contact pin 42*a* and connected through the electronic filter 34 prior to reconnection with the contact pin 42*a* via the soldering site 53, through the conductive hole 3', electronic filter 34, screw 44, conductive central hole 41*a*, conductive central hole 41*d*, trace $T^1$, and contact point C. When the shield 14 is connected thorough the electronic filter 34, my balanced interface audio connector 30 functions as a ground lift to break a problematic ground current loop; wherein, any current flowing along the shield 14 has no effect on the final audio program. Additionally, by connecting the shield through the electronic filter 34, radio frequency interference, electro-magnetic interference, or both, are prevented from inductively coupling onto the shield 14 and contaminating the final audio program.

As depicted in FIG. 7, the female XLR type connector 30*c* includes a one-part metal housing 45, a female socket connecting component FP with three conductive contact sockets 142*a*, 142*b*, 142*c* held in place by an insulating mounting component B. In relation to a conventional female XLR connector, conductive contact sockets 142*a*, 142*b*, and 142*c* equate respectively to contact socket 1, contact socket 2, and contact socket 3; however, contact socket 1 (142*a*) and 2 (142*b*) are in reversed locations from contact pins 1 (42*a*) and 2 (42*b*) on the male XLR connector 30*a*, but function as described above. The circuit board $PCB^1$, insulating member I, circuit board $PCB^2$, and the toggle switch TS are mounted to an inner end E4*a* via the screw 44. The socket connecting component FP is inserted into the metal housing 60. The housing 60 has an elongated T-shaped groove 62 and an externally threaded end E13 that connects to the end E7 of the rear-housing member 48. When the female XLR connector 30*c* is assembled, the post 51 abuts against, and makes a conductive connection with the contact point C of the circuit board $PCB^1$. Activating and deactivating the electronic filter 34 on the connector 30*c* functions as connector 30*a* discussed above. As depicted in FIG. 8, the TRS type connector 30*d* includes a jack connecting component plug JP. The circuit board $PCB^1$, insulating member I, circuit board $PCB^2$, and the toggle switch TS are mounted to an inner end E4*b*. The connector 30*d* is assembled and functions the same as connector 30*a* discussed above.

Figure 11A:
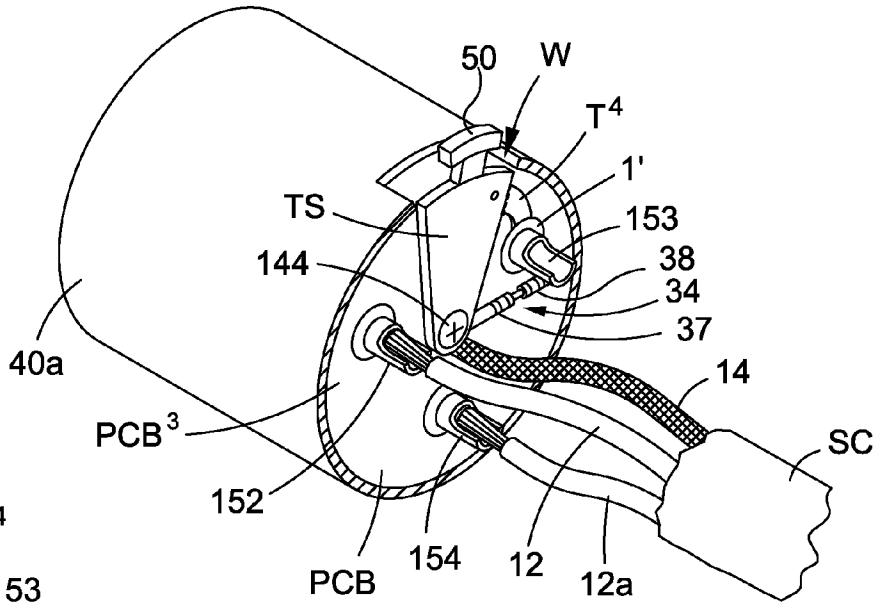
FIG. 11A is a perspective view showing an alternate embodiment of a shielded cable connected to my balanced interface audio connector.
Figure 11:
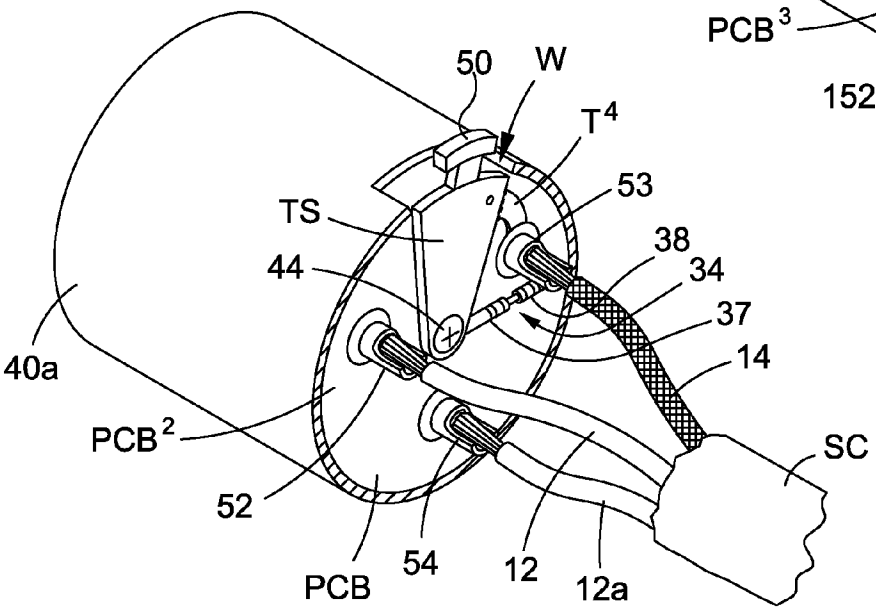
FIG. 11 is a rear perspective view showing a shielded cable connected to my balanced interface audio connector.

Depicted in FIGS. 6A and 11A, is an alternate embodiment of my balanced interface audio connector 30, designated by the numeral 30*b*. The male connecting component plug MP has three connection or soldering cups 152, 153, and 154 which are portions of the contact pins 142*a*, 142*b*, 142*c*, conventionally projecting from the inside face of the insulating mounting component B of the male connecting plug MP. The printed circuit board $PCB^3$ has one conductive through-hole 1', and two non-conductive through-holes 2' and 3' therein, to receive, respectively, each contact pin 142*a*, 142*b* and 142*c* of the male connecting plug MP. The printed circuit board $PCB^3$ contains a central hole 41*f* through which a threaded end E8 of the soldering screw 144 passes. As illustrated in FIG. 6A, the toggle switch TS comprises a lever arm 50, a wiper W, a trace $T^3$, and a conductive hole 41*e*. The threaded end E8 of the soldering screw 144 passes through holes 41*e* and 41*f* and screws into a threaded receptacle (not shown) on the inside face of the male connecting plug MP for attaching the toggle switch TS and the printed circuit board $PCB^3$ to the male connecting plug MP. The toggle switch TS is mounted at its inner end E10 to pivot. The Hi line 12 of the cable SC is connected to the soldering site 152. The Lo line 12*a* of the cable SC is connected to the soldering site 154. The shield 14 is connected to the soldering screw 144. As illustrated in FIG. 11A, the printed circuit board PCB contains the electronic filter 34 comprising a resistor 37, a capacitor 38, and a trace $T^4$. With the toggle switch TS in the first closed position the electronic filter 34 is deactivated and the shield 14 is conductively connected to the contact pin 142*a* via the soldering screw 144, through the conductive central hole 41*e*, trace $T^3$, wiper W, trace $T^4$, conductive hole 1', and the soldering cup 153. With the toggle switch TS in the second open position the electronic filter is activated and the shield 14 is disconnected from the contact pin 142*a* and connected through the electronic filter 34 prior to reconnection with the contact pin 142*a* via the soldering screw 144, the conductive central hole 41*e*, through the electronic filter 34, the conductive hole 1', and the soldering cup 153. The connector 30*b* is assembled and functions the same as connector 30*a* discussed above.

Figure 3B:
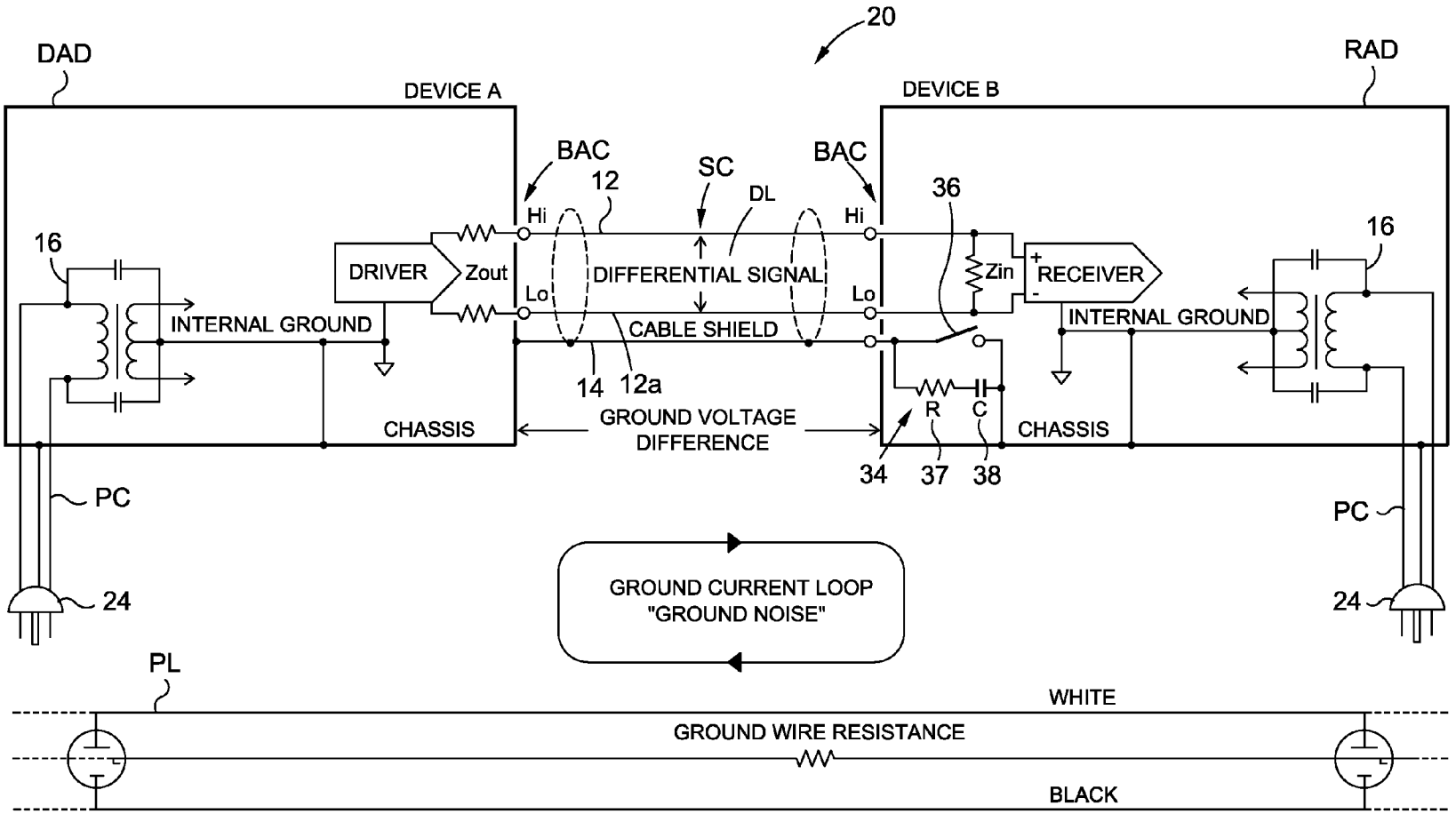
FIG. 3B is a diagram illustrating an alternate embodiment of my system incorporating my balanced interface audio connector and method of use within an audio device.

Illustrated in FIG. 3B is an alternate embodiment of my balanced interface audio connector with ground lift, system and method of use; wherein, my electronic filter 34, manually operable switch 36, and method of use are incorporated directly into the receiver audio device RAD; functioning the same as connector 30*a* discussed above. By incorporating the electronic filter 34 and manually operable switch 36 directly into an audio device, a shielded cable with a conventional balanced audio connector BAC can be used to interconnect audio devices. Additionally, for convenience, the manually operable switch 36 can be located on any portion of the audio device.

Kit and Assembly Instructions

Figure 10:
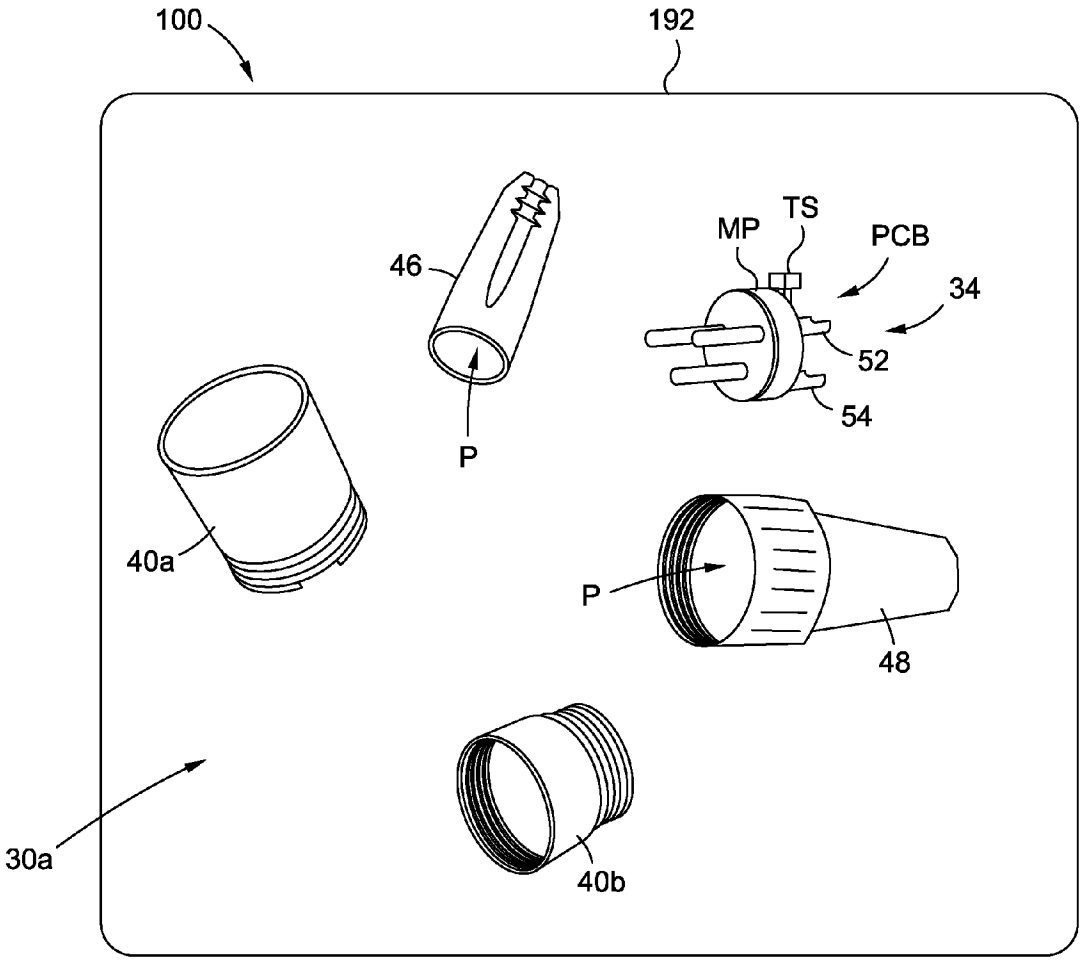
FIG. 10 is a plan view of one embodiment of my kit.

A kit 100 is used to package together the major components of my balanced interface audio connector 30. As depicted in FIG. 10, the kit 100 comprises a package 192, for example, a plastic zip lock bag containing the disassembled components of a single balanced interface audio connector 30*a*. As illustrated in this example, the package 192 contains the male connecting plug MP, a male plug element; however, a female plug element is used also depending on the application. The male connecting plug MP has the pre-assembled printed circuit board PCB, which includes the printed circuit board $PCB^1$, insulating member I, printed circuit board $PCB^2$, screw 44, electronic filter 34, and the manually operable toggle switch TS for activating or deactivating the filter 34. A technician would connect these disassembled components, in the following manner.

1. Open the package 192 of the kit 100 and secure the male connection plug MP in place with a small vise. Place solder into the cup 52 and 54 at the back of pin 42*b* and pin 42*c*, and place solder into the cup 53 on the printed circuit board $PCB^2$ to prepare it for wire connection.

2. Slide the rear metal housing 40*b* and the rear-housing member 48 over an end of the shielded cable SC. Carefully strip the outer insulating sheath of the cable SC about 1 inch, straighten the cable shield braid 14 and twist the braid together. Strip the two inner differential conductor lines 12 and 12*a* about ¼ inch.

3. Tin the lines 12 and 12*a* and the shield 14 by applying heat from a soldering iron and melting solder into theses wires. The solder will flow onto the wires and, when cooled, should again appear shiny.

4. Connect the contact pins as follows. Viewed from the solder side, the cable shield 14 (ground) is connected to the top right cup 53. Hi line 12 (in phase) is connected to the top left cup 52, and Lo line 12*a* (out of phase) is connected to the bottom cup 54.

5. Apply the tinned wires (14, 12, 12*a*) to the cups (52, 53, 54) by touching a cup with the soldering iron until the solder melts, then push the wire into its respective cup. Move the soldering iron away and the connection is made as the solder flows together. Again, when cooled the solder should appear shiny.

6. Slide the front metal housing 40*a* over the male connection plug MP and secure to the rear metal housing 40*b* via the internal threading. Then, attach the strain relief member 46 to the cable SC using the slot on one side of the strain relief member 46. Finally, screw the rear-housing member 48 onto the rear metal housing 40*b*.

Method of Eliminating Ground Loops

1. A driver audio device DAD, for example a preamplifier, and a receiver audio device RAD, for example an equalizer, are conventionally plugged into a utility AC power line PL.

2. A shielded cable SC incorporating at least one of my assembled balanced interface audio connectors 30 is used to interconnect the driver audio device DAD and receiver audio device RAD. For example, the end of the shielded cable SC connected to the input of the receiver audio device RAD may include my male XLR balanced interface audio connector 30*a*.

3. A technician monitors the audio output signal of the receiver audio device RAD and ascertains whether there is any ground noise in the final audio program signal. If it is determined there is a ground current loop in the audio signal path, the electronic filter 34 on my balanced interface audio connector 30*a* can be activated to safely break the ground current loop.

4. To activate the electronic filter 34, a technician manually actuates the toggle switch TS into the second open position (FIGS. 9 and 9B). Once the electronic filter 34 is activated, the shield 14 is internally disconnected from conductive contact pin 42*a* and connected through the electronic filter 34, prior to reconnection with contact pin 42*a*.

5. Upon activating the electronic filter 34 a technician monitors the audio output signal of the receiver audio device RAD and ascertains that there is no longer any ground noise in the final audio program signal.

SCOPE OF THE INVENTION

The above presents a description of the best mode I contemplate of carrying out my audio connector, kit, system and method, and of the manner and process of making and using them, in such full, clear, concise, and exact terms as to enable a person skilled in the art to make and use. My audio connector, kit, system and method is, however, susceptible to modifications and alternate constructions from the illustrative embodiments discussed above which are fully equivalent. Consequently, it is not the intention to limit my audio connector, kit, system and method to the particular embodiments disclosed. On the contrary, my intention is to cover all modifications and alternate constructions coming within the spirit and scope of my audio connector, kit, system and method as generally expressed by the following claims, which particularly point out and distinctly claim the subject matter of my invention:

The invention claimed is:

1. A balanced interface audio connector for connecting together two audio devices with a cable that has a pair of conductive differential lines within a shield, said connector comprising a housing having a first section and a second section that are adapted to be attached together and detached, and a connecting component adapted to be enclosed within attached the first and second sections forming the housing, said connecting component having a proximate end configured so that an attached shielded cable extends therefrom and a distal end to be connected directly to one of the two audio devices, an insulating mounting component having a first face and a second face, a first, a second, and a third conductive element extending from the first face for making electrical connection at said distal end directly to one of the two audio devices, the first conductive element for making electrical connection to the shield of the cable and the second and third conductive elements for making electrical connection to the pair of conductive differential lines of the cable, and a circuit board at the second face carrying a circuit including an electronic filter and a first conductive connection site in individual electrical contact with the first conductive element, and a manually operable switch moveable between a first position and a second position, the first connection site configured to enable said first connection site to be individually electrically connected to the shield of the cable, upon connection of said first connection site to a cable, the movement to the first position of the switch deactivates said electronic filter and the shield remains connected to the first connection site and the movement to the second position of the switch activates the electronic filter simultaneously disconnecting the shield from the first connection site and connecting the shield through the filter prior to reconnection with the first connection site.

2. The audio connector of claim 1 where the electronic filter is a resistor and capacitor network.

3. The audio connector of claim 1 where the electronic filter is a capacitor network.

4. The audio connector of claim 1 where the distal end of the connecting component is a socket element.

5. The audio connector of claim 1 where the distal end of the connecting component is a plug element.

6. A balanced interface audio connector for connecting together two audio devices with a cable that has a pair of conductive differential lines within a shield, said connector including a control circuit comprising an electronic filter and a manually operable switch, said switch having a first position deactivating the electronic filter and allowing the shield to maintain electrical continuity through a connection element and a second position activating the electronic filter and disconnecting the shield from a connection element of the shield and connecting the shield through the electronic filter prior to reconnection with its connection site.

7. A balanced interface audio connector incorporated into an audio device, said connector including a control circuit comprising an electronic filter and a manually operable switch, said switch having a first position deactivating the electronic filter and allowing the shield to maintain electrical continuity through a connection element and a second position activating the electronic filter and disconnecting the shield from the shield's connection element and connecting the shield through the electronic filter prior to reconnection with its connection site.

8. A kit comprising a package holding a plurality of components that, upon being manually assembled together, make a balanced audio connector for connecting together two audio devices with a cable that has a pair of conductive differential lines within a shield, at least one of said components being a plug component having an outside face and an inside face and three contact pins, a first pin for making electrical connection to the shield of the cable and a second pin and a third pin for making electrical connection to the pair of conductive differential lines of the cable, said pins extending through the plug component and having a first pin portion projecting from the outside face that is adapted to be detachably connected directly to one of the audio devices and a second pin portion projecting from the inside face that is adapted to be connected to a connection end of the cable, and a circuit board having a shield connection site configured to enable the first pin to be electrically connected to a portion of the shield extending from the connection end of the cable, and a circuit including an electronic filter, and a manually operable switch for opening the circuit to disconnect the shield and connect the filter and closing the circuit to deactivate said filter and reconnect to the shield.

9. The kit of claim 8 where said plug component is a male element or a female element.

10. The kit of claim 8 where the electronic filter is a resistor and capacitor network.

11. The kit of claim 8 where the electronic filter is a capacitor network.

12. An audio system comprising a driver device having a metal chassis with an internal ground and a plug for connection to a socket of an AC power line, a receiver device having a metal chassis with an internal ground and a power cord terminating in a plug for connection to another socket of the same or another AC power line, a cable that transmits audio signals from one device to the other device and has opposed ends and a pair of conductive differential lines within a shield, one cable end connected to one device and the other cable end connected to the other device, said shield having opposed ends, one shield end connected to the metal chassis of one device and the other shield end connected to the metal chassis of the other device through a balanced interface audio connector including an electronic filter and a manually operable switch, said switch having a first position deactivating the filter and connecting the shield through a conductive element to the device's chassis and a second position activating the electronic filter and disconnecting the shield from the conductive element, simultaneously connecting the shield through electronic filter prior to reconnection with the conductive element and device's chassis.

13. The system of claim 12 where the electronic filter is a resistor and capacitor network.

14. The system of claim 12 where the electronic filter is a capacitor network.

15. The system of claim 12 where the balanced audio connector is configured as a female socket element.

16. The system of claim 12 where the balanced audio connector is configured as a male plug element.

17. A system of connecting together two audio devices by a cable that has a pair of conductive differential lines within a shield, each audio device having a metal chassis with an internal ground and a power cord terminating in a plug for connection to a socket of an AC power line, said devices to have their respective plugs connected to different sockets, whereby, upon connecting the respective plugs of the devices to different sockets of the same or another AC power line, a ground noise can flow and create a ground current loop, said system including means for connecting one end of the shield to the metal chassis of one device and another end of the shield to the metal chassis of the other device through a balanced audio connector including means for creating a ground lift to safely break a ground current loop between the connected audio devices.

18. The system of claim 17 where said means for creating a ground lift include an electronic filter, and a manually operable switch, said switch having a first position deactivating the filter and allowing the shield to maintain electrical continuity through a contact element with the chassis of the devices, and a second position activating the filter and disconnecting the shield from the contact element, connecting the shield through the electronic filter, and reconnecting the shield, through a contact element, to the chassis of the devices.

19. A method of connecting together two audio devices by means of a cable that has a pair of conductive differential lines within a shield, each audio device having a metal chassis with an internal ground and a power cord terminating in a plug for connection to a socket of an AC power line, said devices to have their respective plugs connected to different sockets of the same or another AC power line, whereby ground noise can flow and create a ground current loop, said method comprising connecting one end of the shield to the metal chassis of one device and another end of the shield to the metal chassis of the other device through a balanced audio connector including means for creating a ground lift to safely break a ground current loop between the connected audio devices.

20. The method of claim 19 where said means for creating a ground lift include an electronic filter, and a manually operable switch, said switch having a first position deactivating the filter and allowing the shield to maintain electrical continuity through a contact element with the chassis of the devices, and a second position activating the filter and disconnecting the shield from the contact element, connecting the shield through the electronic filter, and reconnecting the shield, through a contact element, to the chassis of the devices.

* * * * *

UNITED STATES PATENT AND TRADEMARK OFFICE

CERTIFICATE OF CORRECTION

PATENT NO. : 9,054,463 B2
APPLICATION NO. : 14/032972
DATED : June 9, 2015
INVENTOR(S) : Avedis Kifedjian It is certified that error appears in the above-identified patent and that said Letters Patent is hereby corrected as shown below:

In the claims

On Column 10, Line 48, the word "attached" is not required and should be deleted.

Signed and Sealed this
Third Day of May, 2016

Michelle K. Lee

Michelle K. Lee
*Director of the United States Patent and Trademark Office*